United States Patent [19]

Kester et al.

[11] 4,384,872

[45] May 24, 1983

[54] STABILIZED GASOLINE-ALCOHOL FUEL COMPOSITIONS

[75] Inventors: Frank L. Kester, La Grange; Robert V. Fitzsimmons, St. Charles; Donald L. Klass, Barrington, all of Ill.

[73] Assignee: Institute of Gas Technology, Chicago, Ill.

[21] Appl. No.: 17,571

[22] Filed: Mar. 5, 1979

[51] Int. Cl.[3] ..... C10L 1/22

[52] U.S. Cl. ..... 44/56; 252/351; 252/357

[58] Field of Search ..... 44/56; 252/351, 357

[56] References Cited

U.S. PATENT DOCUMENTS

| | | | |
|---|---|---|---|
| 1,869,486 | 8/1932 | Lantz | 44/56 |
| 2,317,555 | 4/1943 | Robinette | 252/357 |
| 2,559,584 | 7/1951 | Barker | 252/357 |
| 2,920,948 | 1/1960 | Weeks | 44/56 |
| 4,154,580 | 5/1979 | Landis | 44/56 |

*Primary Examiner*—Charles F. Warren
*Assistant Examiner*—Y. Harris-Smith
*Attorney, Agent, or Firm*—Thomas W. Speckman

[57] ABSTRACT

Motor fuel composition of about 5 to 50 weight percent methanol, ethanol or mixtures thereof in gasoline with a minor amount of a selected surface active agent which significantly increases the water tolerance of the gasoline-alcohol fuel composition. Suitable surface active additive agents include higher alcohols, higher primary amines, alkyl amides and urea, alkyl ethers and dioxane and alkylphenoxy-polyethoxylated ethanols.

20 Claims, No Drawings

STABILIZED GASOLINE-ALCOHOL FUEL COMPOSITIONS

This invention relates to improved motor fuel compositions and particularly to motor fuel composition blends of gasoline and methanol, ethanol or mixtures thereof together with a surface active agent providing increased water toleration.

Low molecular weight aliphatic alcohols have been used as components of gasoline fuels, methyl, ethyl, isopropyl and butyl alcohols being known to possess high octane ratings and their use to impart a higher octane rating to gasoline has been long attempted. As high quality gasoline becomes increasingly scarce and more expensive, the use of a suitable extender obtainable from an abundant source becomes increasingly important. Also, there have been attempts to produce high octane gasoline from methanol, but these processes have not proved entirely economically feasible.

U.S. Pat. No. 3,082,070 teaches a mixture of up to about 50 volume percent methanol in gasoline and a monocarboxcyclic acid or its t-alkyl ester resulting in a synergistic effect for increasing octane rating in gasoline containing a substantial concentration of aromatics and/or olefins. U.S. Pat. No. 2,995,427 recognizes problems encountered with water present in a gasoline composition resulting in phase separation in a gasoline-water-methanol system. The U.S. Pat. No. 2,995,427 teaches dispersal of water in a gasoline composition containing up to 5 volume percent methanol by the addition of small amounts of a fatty acid amide of hydroxyethyl ethylenediamine and a small amount of an oil-soluble ammonium sulfonate. U.S. Pat. No. 2,404,094 recognizes the need to prevent separation of alcohols from gasoline by small amounts of water and attempts to overcome the problem in methanol-gasoline blends, which are predominately methanol, by addition of an alkane or alkene having 3 to 5 carbon atoms. The above are exemplary of the numerous attempts to render gasoline and lower alcohol fuel compositions more tolerable of small amounts of water.

The problems of phase separation of motor fuel compositions including methanol, ethanol and mixtures thereof, and gasoline, have been recognized. Small amounts of water are frequently present in the fuel, for example, from contamination or atmospheric condensation. Such problems of phase separation are enhanced as the proportion of methanol or ethanol to gasoline is increased, particularly, when the weight percent alcohol is increased to over 5 percent of the fuel composition.

Accordingly, it is an object of this invention to provide a motor fuel composition of gasoline and methanol, ethanol or mixtures thereof having improved water tolerance.

It is another object of this invention to provide a motor fuel composition having about 5 to 50 weight percent methanol, ethanol or mixtures thereof blended with gasoline providing tolerance to more than about 0.3 volume percent water without phase separation.

It is still another object of this invention to provide a motor fuel composition having about 5 to 50 weight percent methanol, ethanol or mixtures thereof blended with gasoline providing high water tolerance by addition of a minor amount of a selected surface active agent.

Gasoline is a mixture of hydrocarbons boiling in the approximate range of 40° to 200° C. used as a fuel for internal combustion engines. Currently in the United States, it is desired to increase use of gasoline without tetraethyl lead which is added to increase the octane rating. More widespread use of lead-free gasoline has shown the need to increase octane ratings of the lead-free gasoline due to prevalent engine knocking. Further, in attempts to increase mileage as required by government regulation, automobile manufacturers may be forced to produce engines with higher compression ratios resulting in even greater demands for higher octane unleaded gasoline. Use of about 5 to 50 weight percent of an alcohol selected from the group consisting of methanol, ethanol and mixtures thereof in a gasoline based motor fuel composition achieves the goals of increasing octane rating and providing an effective extender for gasoline. About 15 to 30 weight percent of the alcohol is preferred.

We have found that addition of relatively small amounts of selected surface active agents markedly improve the water tolerance of motor fuel compositions having about 5 to 50 weight percent methanol, ethanol or mixtures thereof mixed with gasoline having a mixture of hydrocarbon components boiling between 40° and 200° C. We have found that selected surface active agents have the property of modifying the surface or interfacial properties in gasoline-lower alcohol compositions of up to 50 weight percent alcohol sufficiently to substantially prevent phase separation.

About 0.01 to 5 weight percent of the selected surface active agent is desired to reduce the interfacial tension of water in the composition to less than about 40 dynes per centimeter at 20° C., and preferably to less than about 20 dynes per centimeter at 20° C. While the optimal amount of the additive is somewhat different dependent upon the specific surface active agent selected, generally about 0.2 to 4 weight percent is preferred.

While some surface active agents, such as lauryl sodium sulfate, have been found to have a negative effect and others, such as polyamines, no effect upon the toleration of water in an 80 percent gasoline—20 percent methanol composition, we have found selected surface active agents do have positive effect in lowering interfacial tension thereby substantially increasing water tolerance without phase separation. Suitable surface active agents are selected from the group consisting of ROH, $R\text{-}NH_2$, $R'CO\text{-}NH_2$, $R''^1\text{-}O\text{-}R''^2$, $R'''(CH_2CH_2O)_xH$ and dioxane wherein R is an alkyl group of 4 to 10 carbon atoms, R' is either $-NH_2$ or an alkyl group of 1 to 7 carbon atoms and $R''^1$ and $R''^2$ are each an alkyl group of 2 to 7 hydrocarbon atoms, R''' is an alkyl phenol group where the alkyl group has 5 to 9 carbon atoms and x is an integer of 5 to about 15. The alkyl groups may be straight or branched chain or cyclic. Specific surface active agents which improve the water tolerance of gasoline-methanol blends include higher alkanols such as butanol, pentanol, hexanol, heptanol, octanol, nonanol, and decanol. Particularly preferred are normal pentanol and normal octanol. Also effective are alkyl primary amines such as butyl amine, pentyl amine, hexyl amine, heptyl amine, octyl amine, nonyl amine, and decyl amine. Also useful are alkyl amides such as methyl amide, ethyl amid, propyl amide, butyl amide, pentyl amide, hexyl amide, heptyl amide and urea. Urea is particularly preferred because of its high effectiveness at low concentration and its low cost and abundant availability. Alkyl ethers such as ethyl, propyl, butyl, pentyl, hexyl and heptyl ethers which may be symmetrical or non-symmetrical are suitable. Cyclic ethers such as dioxane are suitable. Non-ionic surfactants such as alkyl phenols with polyethoxylated groups are suitable including heptylphenoxy polyethoxy ethanol, octylphenoxy polyethoxy ethanol and nonylphenoxy polyethoxy ethanol. Particularly preferred is octylphenoxy polyethoxy ethanol.

Advantages of the present invention are illustrated in the following specific example which is set forth for the purpose of illustration and should not be construed as limiting the invention.

EXAMPLE

A gasoline-methanol composition was made using 78.5 weight percent regular gasoline obtained from a Mobil Oil Corporation gas station and 21.5 weight percent methanol. Volumetrically measured amounts of water were added to the gasoline-methanol composition and the amount of water resulting in phase separation at room temperature determined. The test was repeated for the additives noted in the following Table with the tolerance noted.

TABLE

| Additive | Weight Percent Additive | Volume Percent Water Tolerated |
|---|---|---|
| None | 0 | 0.3 |
| n-pentyl alcohol | 4 | 1.1 |
| n-octyl alcohol | 3.2 | 1.0 |
| Urea | 0.4 | 0.6 |
| Dioxane | 1.9 | 0.6 |
| Octylphenoxypolyethoxy ethanol | 0.4 | 0.6 |

It is seen that minor amounts of the selected surface active agents increase water toleration of a gasoline-methanol fuel composition significantly, in the order of up to over 300 percent.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

We claim:

1. A motor fuel composition comprising:

about 5 to 50 weight percent of an alcohol selected from the group consisting of methanol, ethanol and mixtures thereof;

about 0.1 to 5 weight percent of a surface or interfacial modifying agent selected from the group consisting of normal ROH, R-$NH_2$, R'CO-$NH_2$, $R''^1$-O-$R''^2$, dioxane and $R'''(CH_2CH_2O)_xH$ wherein R is an alkyl group of 5 to 10 carbon atoms, R' is either -$NH_2$ or an alkyl group of 1 to 7 carbon atoms, $R''^1$ and $R''^2$ are each an alkyl group of 2 to 7 hydrocarbon atoms and R''' is an alkyl phenol group where the alkyl group has 5 to 9 carbon atoms and x is an integer from 5 to about 15; and the balance thereof being gasoline.

2. A motor fuel composition comprising:

about 5 to 50 weight percent of an alcohol selected from the group consisting of methanol, ethanol and mixtures thereof;

about 0.5 to 5 weight percent of a surface or interfacial modifying agent consisting of a primary alcohol having the formula ROH wherein R is a normal alkyl group of 5 to 10 carbon atoms, all alcohols present in said composition being primary alcohols having one normal-alkyl group; and the balance thereof being gasoline.

3. The composition of claim 2 wherein the surface or interfacial modifying agent is normal pentyl alcohol.

4. The composition of claim 2 wherein the surface or interfacial modifying agent is normal octyl alcohol.

5. The composition of claim 1 wherein the methanol content is about 15 to 30 weight percent of the total motor fuel composition.

6. The composition of claim 2 wherein the surface or interfacial modifying agent is about 0.2 to 4 weight percent of the total motor fuel composition.

7. The composition of claim 2 wherein the surface or interfacial modifying agent is about 3 to 5 weight percent normal amyl alcohol.

8. The composition of claim 2 wherein the surface or interfacial modifying agent is about 2 to 4 weight percent normal octyl alcohol.

9. A motor fuel composition comprising:

about 5 to 50 weight percent of an alcohol selected from the group consisting of methanol, ethanol and mixtures thereof;

about 0.1 to 5 weight percent of a surface or interfacial modifying agent $R'''(CH_2CH_2O)_xH$ wherein R''' is an alkyl phenol group where the alkyl group has 5 to 9 carbon atoms and x is an integer from 5 to about 15; and the balance thereof being gasoline.

10. A motor fuel composition comprising:

about 5 to 50 weight percent of an alcohol selected from the group consisting of methanol, ethanol and mixtures thereof;

about 0.1 to 5 weight percent of a surface or interfacial modifying agent urea; and the balance thereof being gasoline.

11. A motor fuel composition comprising:

about 5 to 50 weight percent of an alcohol selected from the group consisting of methanol, ethanol and mixtures thereof;

about 1.0 to 2.0 weight percent of a surface or interfacial modifying agent dioxane; and the balance thereof being gasoline.

12. The composition of claim 9 wherein the surface or interfacial modifying agent is about 0.3 to 0.5 weight percent $R'''(CH_2CH_2O)_xH$.

13. The composition of claim 10 wherein the surface or interfacial modifying agent is about 0.3 to 0.6 weight percent urea.

14. A motor fuel composition comprising:

about 5 to 50 weight percent of an alcohol selected from the group consisting of methanol, ethanol and mixtures thereof;

about 0.5 to 5 weight percent of a surface or interfacial modifying agent consisting of a primary amine having the formula $RNH_2$ wherein R is a normal alkyl group of 5 to 10 carbon atoms, all amine compounds present in said composition being primary amines having one normal-alkyl group; and the balance thereof being gasoline.

15. The composition of claim 14 wherein the surface or interfacial modifying agent is about 1.0 to 2.0 weight percent $RNH_2$.

16. The composition of claim 1 wherein said alcohol is methanol.

17. The composition of claim 1 wherein the alcohol is ethanol.

18. The composition of claim 1 wherein said alcohol is a mixture of methanol and ethanol.

19. A motor fuel composition comprising:

about 5 to 50 weight percent of an alcohol selected from the group consisting of methanol, ethanol and mixtures thereof;

about 0.01 to 5 weight percent of a surface or interfacial modifying agent dioxane; and the balance thereof being gasoline.

20. A motor fuel composition comprising:

about 5 to 50 weight percent of an alcohol selected from the group consisting of methanol, ethanol and mixtures thereof;

about 0.01 to 5 weight percent of a surface or interfacial modifying agent $R''^1$-O-$R''^2$ wherein $R''^1$ and $R''^2$ are each an alkyl group of 2 to 7 carbon atoms; and the balance thereof being gasoline.

* * * * *